US008349782B2

(12) United States Patent
Byrne et al.

(10) Patent No.: US 8,349,782 B2
(45) Date of Patent: Jan. 8, 2013

(54) HYDROPHOBIC AND PARTICULATE SOIL REMOVAL COMPOSITION

(75) Inventors: Lucia J. Byrne, Bloomington, MN (US); David J. Falbaum, Minneapolis, MN (US); Jerry D. Hoyt, Hastings, MN (US)

(73) Assignee: Ecolab USA Inc., St. Paul, MN (US)

( * ) Notice: Subject to any disclaimer, the term of this patent is extended or adjusted under 35 U.S.C. 154(b) by 172 days.

(21) Appl. No.: 13/027,743

(22) Filed: Feb. 15, 2011

(65) Prior Publication Data

US 2012/0208735 A1 Aug. 16, 2012

(51) Int. Cl.
*C11D 17/00* (2006.01)

(52) U.S. Cl. ..... 510/189; 510/241; 510/242; 510/421; 510/463

(58) Field of Classification Search ..... None
See application file for complete search history.

(56) References Cited

U.S. PATENT DOCUMENTS

| | | | |
|---|---|---|---|
| 4,852,593 | A | 8/1989 | Daugherty |
| 5,041,235 | A | 8/1991 | Kilbarger |
| 5,534,199 | A | 7/1996 | Winkler, III |
| 5,556,833 | A | 9/1996 | Howe |
| 5,560,073 | A | 10/1996 | Ragas |
| 5,759,980 | A | 6/1998 | Russo et al. |
| 5,853,127 | A | 12/1998 | Heembrock |
| 5,871,590 | A | 2/1999 | Hei et al. |
| 6,281,189 | B1 | 8/2001 | Heimann et al. |
| 6,329,060 | B1 | 12/2001 | Barkac et al. |
| 6,440,910 | B1 | 8/2002 | Smith et al. |
| 6,448,209 | B1 | 9/2002 | Gatzke et al. |
| 6,462,011 | B1 | 10/2002 | Collins et al. |
| 6,491,928 | B1 | 12/2002 | Smith, III |
| 6,506,243 | B1 | 1/2003 | Yezrielev et al. |
| 6,586,366 | B1 | 7/2003 | Auda et al. |
| 6,762,157 | B1 | 7/2004 | Babinski et al. |
| 6,949,271 | B2 | 9/2005 | Shannon et al. |
| 7,045,021 | B2 | 5/2006 | Ewing et al. |
| 7,119,053 | B2 | 10/2006 | Jordan et al. |
| 7,192,912 | B2 | 3/2007 | Laux |
| 7,323,438 | B2 | 1/2008 | Hedges et al. |
| 7,381,695 | B2 | 6/2008 | Minevski |
| 7,390,773 | B2 | 6/2008 | Minevski |
| 7,595,291 | B2 | 9/2009 | Bittner et al. |
| 8,119,588 | B2 * | 2/2012 | Bernhardt et al. ..... 510/495 |
| 2003/0125223 | A1 | 7/2003 | Denton |
| 2003/0216268 | A1 | 11/2003 | Swensen |
| 2003/0216281 | A1 | 11/2003 | Deleo et al. |
| 2004/0144406 | A1 | 7/2004 | Garabedian et al. |
| 2004/0181009 | A1 | 9/2004 | Shelton et al. |
| 2004/0253297 | A1 | 12/2004 | Hedges et al. |
| 2004/0259754 | A1 | 12/2004 | Gohl et al. |

(Continued)

FOREIGN PATENT DOCUMENTS

| | | |
|---|---|---|
| EP | 178164 | 4/1988 |

(Continued)

*Primary Examiner* — Necholus Ogden, Jr.
(74) *Attorney, Agent, or Firm* — Andrew D. Sorensen; Shaoni L. Mitchell

(57) ABSTRACT

The invention relates to a hydrophobic and particulate soil removal composition and method for removal of hydrophobic and particulate soil from an article. Stubborn hydrophobic greasy or oily soils, including associated organic particulate soils, such as finely divided elemental carbon, are frequently encountered on hard surfaces including vehicle parts. The composition is selected to provide enhanced soil removal, preferably in vehicle cleaning applications.

25 Claims, 4 Drawing Sheets

U.S. PATENT DOCUMENTS

| | | | |
|---|---|---|---|
| 2005/0197277 | A1 | 9/2005 | Gallagher et al. |
| 2005/0209123 | A1 | 9/2005 | Laux |
| 2005/0227898 | A1 | 10/2005 | Leskowicz et al. |
| 2005/0250661 | A1 | 11/2005 | Bragulla |
| 2006/0094627 | A1 | 5/2006 | Mouser et al. |
| 2006/0100119 | A1 | 5/2006 | Smith |
| 2006/0147503 | A1 | 7/2006 | Floyd |
| 2007/0068554 | A1 | 3/2007 | Essenburg |
| 2007/0227557 | A1 | 10/2007 | Ohlhausen et al. |
| 2007/0243101 | A1 | 10/2007 | Johnson |
| 2008/0103082 | A1 | 5/2008 | Palmer et al. |
| 2008/0167215 | A1 | 7/2008 | Bittner et al. |
| 2008/0185019 | A1 | 8/2008 | Hodge et al. |
| 2008/0271761 | A1 | 11/2008 | Sherrel et al. |
| 2009/0098386 | A1 | 4/2009 | Martin et al. |

FOREIGN PATENT DOCUMENTS

| | | |
|---|---|---|
| EP | 1313815 | 5/2006 |
| GB | 2288190 | 10/1995 |
| JP | 4262947 | 9/1992 |
| JP | 6039846 | 2/1994 |
| JP | 2000071947 | 3/2000 |
| JP | 2002067889 | 3/2002 |
| JP | 2002348597 | 12/2002 |
| WO | WO96/03469 | 2/1996 |
| WO | WO96/16131 | 5/1996 |
| WO | WO03/105793 | 12/2003 |

* cited by examiner

HYDROPHOBIC AND PARTICULATE SOIL REMOVAL COMPOSITION

FIELD OF THE INVENTION

The invention relates to a hydrophobic and particulate soil removal composition and method for removal of hydrophobic and particulate soil from an article. Stubborn hydrophobic greasy or oily soils, including associated organic particulate soils, such as finely divided elemental carbon, are frequently encountered on hard surfaces including vehicle parts. The composition is selected to provide enhanced soil removal, preferably in vehicle cleaning applications.

BACKGROUND OF THE INVENTION

The invention relates to a one step wheel cleaner that effectively targets numerous soils. Wheels become contaminated with a number of soils, such as, oily soils, road dirt (which is highly regional) and brake dust soils. In situations were road dirt contains high silicate levels or contains clay, a traditional alkaline cleaner does not always remove the soils effectively. As such, a number of regional wheel cleaners exist in the marketplace in which these products only work in one regional area rather than nationwide. Therefore, there is a need in the industry for a wheel cleaner that can target traditional soils and all regional soils that build up on wheels.

Traditionally, solvents such as butyl cellosolve (2-butoxyethanol) have been used in wheel cleaners to aid in soil removal. However, butyl cellosolve has a negative safety and environmental profile because it is a volatile organic compound, is a respiratory hazard and irritating to skin. Therefore, there is a need in the industry for a volatile organic compound free wheel cleaner.

The invention relates to a hydrophobic and particulate soil removal composition that effectively targets both traditional soils and regional soils using a coco-based solvent which is free of volatile organic compounds.

BRIEF DESCRIPTION OF THE INVENTION

A hydrophobic and particulate soil removal composition is provided by the invention. The hydrophobic and particulate soil removal composition includes an effective soil treating amount of an alkyl ethoxylate mixture containing two or more ethoxylate groups per molecule and having the formula:

$$R_1—(OC_2H_4)_m—OH$$

wherein R1 contains about 6 to about 26 carbon atoms and m is an average value of 1 to 20. Preferably, R1 is a linear saturated aliphatic group. The alkyl ethoxylate component is preferably an alcohol ethoxylate or an alkyl phenol ethoxylate.

The hydrophobic and particulate soil removal composition also includes an effective soil treating amount of a coco-based fatty acid ester component having the formula:

$$R_3—CO_2—R_4$$

wherein R3 is an alkyl group having about 6 to about 24 carbon atoms and R4 is an alkyl group having about 1 to about 6 carbon atoms. The soil removal composition is preferably substantially free of hydrocarbons.

The weight ratio of alkyl ethoxylate component to fatty acid ester component is preferably between about 1:8 and about 8:1, and more preferably between about 6:1 and about 1:6. It should be appreciated that the alkyl ethoxylate component can include mixtures of different alkyl ethoxylates, and the fatty acid ester component can include mixtures of different fatty acid esters. In addition, the soil removal composition can include a chelant, an alkaline agent, a surfactant, a corrosion inhibitor, a hydrotrope, a solubilizing agent, a foaming agent, and other components which are conventional in the detergent industry. The concentration of alkyl ethoxylate component and fatty acid ester component in the soil removal composition depends on the desired use of the composition. Generally, the soil removal composition comprises between about 0.01 wt. % to about 20 wt. % alkyl ethoxylate mixture and between about 0.005 wt. % to about 5 wt. % fatty acid ester component.

A method for removing hydrophobic and particulate soil from an article is provided by the invention. The method includes the step of contacting a soiled article with a hydrophobic and particulate soil removal composition. The hydrophobic and particulate soil removal composition is allowed to penetrate into the soil in order to break apart the soil. The soil removal composition of the invention is particularly suited for breaking apart caked soil. Caked soil can generally be characterized as having an average thickness of between about 0.1 mm and about 10 mm. The soil can be removed from hard surfaces such as those encountered in the automotive industry.

DETAILED DESCRIPTION OF THE DRAWINGS

DETAILED DESCRIPTION OF THE INVENTION

Figure 1:
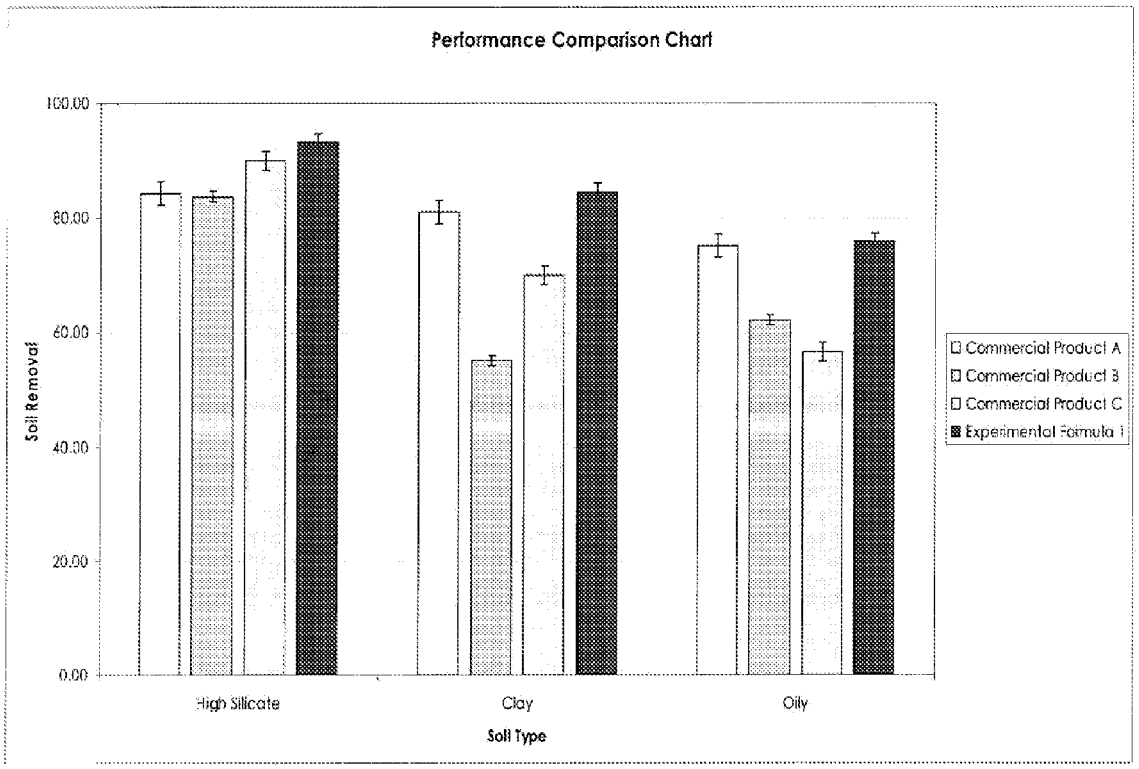
FIG. 1 is a bar graph illustrating the formulation performance data for percent soil removal for high silicate, clay, and transportation oily soil types.

The invention relates to a hydrophobic and particulate soil removal composition, and to a method for removing hydrophobic and particulate soil from an article. It should be understood that hydrophobic and particulate soils refer to oily or greasy soils containing particulate matter. In general, this type of soil can often be characterized by a caked appearance. Exemplary hydrophobic soils include hydrocarbons, tars, bitumens, asphalts, rubber, road film, brake dust etc. Exemplary particulates which can be found in the hydrophobic soil include carbon, limestone, concrete, mineral clays, sand, dirt, clays, natural mineral matter, carbon black, graphite, graphitic materials, caolin, environmental dust, etc. In general, soils which are of particular concern include clean and dirty motor oils, asphaltenes, hydrocarbon, and coal tars, petroleum greases, transmission fluids, hydraulic oils and greases, and the like. These soils are typical of the soils often found in truck or auto repair shops, fleet maintenance shops, parking lots, brake repair shops, freeways and roads, and are fairly resistant to removal by washing with conventional detergents.

The hydrophobic and particulate soil removal composition can be referred to more simply as the soil removal composition. It should be appreciated that there is no requirement that the soil which is to be removed contain a certain level of particulate matter. Rather, the soil can contain essentially no particulate matter. It is expected that the hydrophobic soil encountered in certain environments will typically contain particulates. In addition, it is understood that the particulate matter is generally considered at least partly responsible for providing "caked soil" for which the composition of the invention is particularly suited for removing or breaking apart. Caked soil can generally be characterized as having a thickness of between about 0.1 mm and about 10 mm. In general, caked soil will exhibit an average thickness of great than about 0.25 mm. Most common caked soils have an average thickness of about 1 mm. In addition, caked soils generally exhibit a viscosity of greater than about 1000 cps.

The soil removal composition includes an effective soil treating amount of an alkyl ethoxylate component, and an effective soil treating amount of a coco-based fatty acid ester component. Applicants find that the combination of the alkyl ethoxylate component and the fatty acid ester component provides enhanced hydrophobic and particulate soil removal properties compared with use of either alkyl ethoxylate component or fatty acid ester component, individually.

The alkyl ethoxylate component includes an ethoxylate or a mixture of ethoxylates. The alkyl ethoxylate component is preferably a nonionic alkyl ethoxylate. Preferred alkyl ethoxylates which can be used according to the present invention preferably have the formula:

$$R_1—(OC_2H_4)_m—OH$$

wherein R1 contains about 6 to about 26 carbon atoms and me is an average value of 1 to 20. R1 can be a group which is considered branched or unbranched, saturated or unsaturated, substituted or unsubstituted, aliphatic or aromatic or aliphatic and aromatic. R1 is preferably a linear saturated aliphatic group. It should be appreciated m reflects an average value, and a particularly preferred alcohol ethoxylate has an m value of about 2-8. Preferred alkyl ethoxylates include alkyl phenol ethoxylates and alcohol ethoxylates. The alkyl phenol ethoxylate preferably has the formula:

$$Ar—(OC_2H_4)_M—OH$$

wherein Ar has a straight or branched alkyl group of about 1 to 9 carbon atoms. The Ar group can include two or more alkyl groups. The alcohol ethoxylate which can be used in the present invention has the formula:

$$R_2—(OC_2H_4)_m—OH$$

wherein R2 is a straight or branched fatty alkyl group containing from about 6 to 24 carbon atoms, preferably about 8 to 18 carbon atoms and most preferably about 9 to 16 carbon atoms, m is an integer of less than about 8.

The fatty acid ester component includes a fatty acid ester or a mixture of fatty acid esters which, when combined with the alkyl ethoxylate, provides penetration into hydrophobic and particulate soil. A preferred fatty acid ester can be represented by the following formula:

$$R_3—CO_2—R_4$$

wherein R3 is a linear or branched alkyl group containing from about 6 to about 24 carbon atoms, and R4 is an alkyl group containing from about 1 to about 6 carbon atoms. Preferably, R3 is an alkyl group containing from about 10 to about 18 carbon atoms, and R4 is an alkyl group containing from about 1 to about 3 carbon atoms. Examples of preferred fatty acid ester include fatty acid esters of soy, oleic, linoleic, linolenic, ricinoleic, cocoinic, myristic, palmitic, and lauric acid. In general, the fatty acid ester component includes at least one of the following: methyl soyate, ethyl soyate, propyl soyate, methyl oleate, ethyl oleate, propyl oleate, methyl ricinoleate, ethyl ricnoleate, propyl ricinoleate, methyl linoleate, ethyl linoleate, propyl linoleate, methyl linolenate, ethyl linolenate, propyl linolenate, methyl cocoate, ethyl cocoate, propyl cocoate, methyl palmitate, ethyl palmitate, propyl palmitate, methyl laurate, ethyl laurate, propyl laurate, methyl myristate, ethyl myristate, and propyl myristate.

The soil removal composition preferably includes the alkyl ethoxylate component and the fatty acid ester component in amounts sufficient to provide desired soil modification performance. In general, the ratio of alkyl ethoxylate component to fatty acid ester component is provided between a range of about 1:6 to about 6:1. A particularly preferred ratio of alkyl ethoxylate component to fatty acid ester component is about 5:1. Specifically, the soil removal composition preferably includes between about 0.01 weight percent to about 20 weight percent alkyl ethoxylate mixture and between about 0.005 weight percent to about 5 weight percent fatty acid ester.

The soil removal composition preferably includes a chelant which acts as an iron oxide sequesterant and/or a metal oxide sequesterant, such as aluminium, calcium, zinc, and/or magnesium. Chelants which can be used according to the invention include sodium gluconate, polyacrylic/polymaleic acid, and tetrasodium EDTA. The amount of chelant incorporated into the soil removal composition of the invention can vary. In general, the soil removal composition preferably includes between about 0.05 weight percent to about 20 weight percent chelant. It should be appreciated that the amount of chelant can vary depending upon the use of the soil removal composition.

The soil removal composition can also preferably include an alkaline agent which helps dissolve grease, oils, fats and protein based deposits. Alkaline agent which can be used according to the present invention include sodium hydroxide, potassium hydroxide, monoethanolamine, potassium carbonate, sodium carbonate, sodium silicate, potassium silicate, and/or trisodium phosphate. The amount of alkaline agent incorporated into the soil removal composition of the invention can vary. In generally, the soil removal composition preferably includes between about 0.05 weight percent to about 15 weight percent alkaline agent. It should be appreciated that the amount of alkaline agent can vary depending upon the use of the soil removal composition.

The soil removal composition can also preferably include additional surfactant components. Preferably, the soil removal composition does not include alkyl ethoxylates having 12 or more ethoxy groups per molecule. Even more preferably, the composition does not include alkyl ethoxylates having 10 or more ethoxy groups, and, in particular, greater than 8 ethoxy groups per molecule. In addition, the soil removal composition of the invention is preferably free of solvent liquid. "Solvent liquid" is defined to be solvents which are generally responsible for providing a composition with a high VOC content. Such solvents are typically referred to as organic solvents such as hydrocarbon solvents. Preferably, the soil removal composition does not include volatile hydrocarbons (C5-11 hydrocarbons) and non-volatile hydrocarbons (C 12-24 hydrocarbons). The soil removal composition of the present invention preferably includes between about 0.001 weight percent to about 5 weight percent of additional surfactants, most preferably a quaternary surfactant.

The soil removal composition can also preferably include additional components such as a corrosion inhibitor, a hydrotrope, a solubilizing agent, and/or a foaming agent. It should be appreciated that the soil removal composition does not require a corrosion inhibitor, a hydrotrope, a solubilizing agent, or a foaming agent. That is, the soil removal composition of the invention can be provided without these additional components.

Corrosion inhibitors which can be used according to the invention include sodium silicate and/or potassium silicate. The amount of corrosion inhibitor incorporated into the soil removal composition of the invention can vary over a wide range. In general, the soil removal composition preferably includes between about 0.001 weight percent to about 5 weight percent corrosion inhibitor.

Hydrotropes which can be used according to the invention include sodium xylene sulfonate, sodium cumene sulfonate, sodium naphthalene sulfonate, potassium xylene sulfonate, potassium cumene sulfonate and/or potassium napthphtalene sulfonate. The amount of hydrotrope incorporated into the soil removal composition of the invention can vary over a wide range. In general, the soil removal composition preferably includes between about 0.01 weight percent to about 5 weight percent hydrotrope.

Solubilizing agents which can be used according to the invention include sodium alkyl dipropionate, sodium alkyl sulfosuccinate, sodium alkyl betaine, potassium alkyl dipropionate, potassium alkyl sulfosuccinate, and/or potassium alkyl betaine. The amount of solubilizing agent incorporated into the soil removal composition of the invention can vary over a wide range. In general, the soil removal composition preferably includes between about 0.001 weight percent to about 10 weight percent solubilizing agent.

Foaming agents which can be used according to the invention include sodium alkyl betaine, sodium alkyl sultaine, sodium alkyl sarcosinate, sodium alkyl sulfonate, sodium alkyl sulfate, potassium alkyl betaine, potassium alkyl sultaine, potassium alkyl sarcosinate, potassium alkyl sulfonate and/or potassium alkyl sulfate. The amount of foaming agents incorporated into the soil removal composition of the invention can vary over a wide range. In general, the soil removal composition preferably includes between about 0.01 weight percent to about 15 weight percent foaming agents.

The compositions of the invention may also contain additional typically nonactive materials, with respect to cleaning properties, generally found in liquid pre-treatment or detergent compositions in conventional usages. These ingredients are selected to be compatible with the materials of the invention and include such materials as soil suspension agents, germicides, pH adjusting agents, viscosity modifiers, perfumes, dyes, inorganic carriers, solidifying agents and the like.

The soil removal composition of the invention will generally be provided in the form of an aqueous liquid or a thickened aqueous liquid. In the liquid formulations, the penetration ingredients of the invention are blended with an aqueous diluent to form a concentrate solution which can then be diluted to a usable product. The thickened liquid product form can be manufactured in an aqueous diluent with a thickening agent. Similarly, the thickened liquid can be diluted with water to form a use solution. The composition can be provided with a sufficiently low viscosity which allows it to flow through a conventional car wash dispenser which is available from Ecolab, Inc. When the composition is diluted to a for use solution, the usable product comprises between full composition to about 1 part concentrated composition to 80 parts water. Additionally, the composition can be provided as a relatively viscous fluid in situations where viscous fluids are desirable including, for example, the treatment of vertical surfaces.

The composition can be used for hard surfaces, it is expected that the soil removal function of the composition will act as the detergent for removing the soil from the hard surface. Exemplary hard surfaces which can be treated by the soil removal composition of the invention include those hard surfaces normally encountered in the automotive washing industry. Exemplary hard surfaces include a rubber hard surface, a metal surface and/or a plastic surface. Specifically, examples of metal surfaces include aluminum, magnesium, steel, chrome-plated aluminum, chrome-plated magnesium, chrome-plated steel, clear coated aluminum, and/or clear coated magnesium.

The foregoing discussion of the invention provides a basis for understanding the ingredients and compositions of the invention. The following exemplary material and data provide a further explanation of the application of the invention to laundry processes and disclose a best mode.

EXAMPLES

Exemplary Formulation

Table 1 listed below illustrates an exemplary formulation for the soil removal composition of the current invention:

TABLE 1

| Ingredient | Description | Quantity (wt. %) |
|---|---|---|
| Water Zeolite Softened | Water | 20-95 wt. % |
| Sodium Gluconate Granular | Chelating Agent | 1-20 wt. % |
| NaOH | Alkaline Agent | 1-10 wt. % |
| Sodium Silicate Solution | Corrosion Inhibitor | 0.1-5 wt. % |
| Polyacrylic/Polymaleic Acid | Chelating Agent | 0.1-10 wt. % |
| Tetrasodium EDTA | Chelating Agent | 0.1-10 wt. % |
| Disodium Octylimino Dipropionate | Coupling Agent | 0.05-5 wt. % |
| Sodium Xylene Sulfonate | Hydrotrope | 0.1-10 wt. % |
| Cocamidopropyl Betaine | Foaming Agent | 0.5-15 wt. % |
| Linear Alcohol Ethoxylate | Wetting Agent | 0.1-10 wt. % |
| Alcohol Ethoxylate | Wetting Agent | 0.1-10 wt. % |
| Quaternary Amine Ethoxylate | Quaternary Surfactant | 0.05-5 wt. % |
| Lauric myristic acid methylester | Non-VOC (coco based) solvent | 0.5-5 wt. % |
| Dye | Dye | 0.01-1 wt. % |
| Fragrance | Fragrance | 0.1-5 wt. % |

Test Procedure

Soil removal tests were performed using a blend of commercially available "wheel cleaning" solutions which contain volatile organic compound solvents in comparison to the soil removal composition of the present invention. Clear coated, painted panels were used for testing. Black panels were used for silicate and clay soil removal tests, whereas, for oily soils, white panels were used. Prior to soiling the panels, the panels were scanned into a computer system which is capable of reading color and gloss measurements. Once the panels were scanned, the panels were moistened with softened water and treated with a hydrophobic drying agent.

To create silicate and clay test panels, slurries were made using 1 part silicate or clay soil dispersed in 1 part water. The soil was chosen based on having a high level of silicate or clay particulates. Panels were then dipped in the slurry and then dried in a 140 degree Fahrenheit oven. This was repeated (without rinsing in between soiling) a total of three times. After the final layer of soil was dried, the panels were allowed to cool and rinsed gently in water. The panels were then dried again fully.

To create oily soil test panels, a thick paintable slurry was made with a blend of dirty motor oil, fresh motor oil, vegetable oil, iron oxide, clay and carbon black which was dissolved in mineral spirits. Using a paint brush, panels were painted evenly with the oily soil. The panel was then baked on a hot plate set to 180 degrees Fahrenheit until the surface smoked and the solvent evaporated (approximately 3 minutes). The panel was then allowed to cool and then re-painted with the oily soil, and this process was repeated until a total of three even layers were applied.

Once the panels were cooled and soiled, the panels were once again scanned into a computer system which is capable of reading color and gloss measurements. Afterwards, each of the cleaning solutions were diluted according to recommended concentrations. The test panels were soaked in the dilution for 30 seconds and then transferred to a test fixture where each panel was rinsed with water for 5 seconds. The test panel was then dried before being scanned again into a computer system which is capable of reading color and gloss measurements.

The following equations were used to calculate efficacy of soil removal:

Use the following equations to calculate efficacy of soil removal.

$$\Delta Es=\sqrt{(L_s-L_i)^2+(a_3-a_i)^2+(b_c-b_i)^2}$$

$$\Delta Ec=\sqrt{(L_c-L_i)^2+(a_c-a_i)^2+(b_c-b_i)^2}$$

$$\text{Efficacy of Soil Removal}=((\Delta Es-\Delta Ec)/\Delta Es)\times 100$$

Where

ΔEc=Cleaned panels

ΔEs=Soiling $L_i$, $a_j$, $b_i$=Initial readings from Miniscan Hunter of cleaned, unsoiled panels $L_s$, $a_s$, $b_s$=Readings from Miniscan Hunter of soiled panels $L_c$, $a_c$, $b_c$=Readings from Miniscan Hunter when panels cleaned Table 2 below illustrates the commercially available "wheel cleaning" solutions and the experimental formulation which were used for comparative testing for soil removal.

TABLE 2

| | | |
|---|---|---|
| Commercial Product A | A highly solvent and concentrated alkaline wheel cleaner which utilizes butyl cellosolve (2-Butoxy Ethanol) as its primary solvent (a VOC solvent) | Evaluated at a concentration of 1:8 |
| Commercial Product B | A mildly alkaline, all-purpose detergent which uses isopropyl alcohol as its primary solvent (a VOC solvent). | Evaluated at a concentration of 1:4 |
| Commercial Product C | A hydrofluoric acid-based detergent (a VOC solvent) | Evaluated at a concentration of 1:25 |
| Commercial Product D | A mildly alkaline detergent which uses citrus based solvents (d-limonene) as its primary solvent (a VOC solvent) | Evaluated at a concentration of 1:10 |
| Experimental Formula | A composition of the current invention which includes a non-VOC solvent in an alkaline concentrate | Evaluated at a concentration of 1:15 |

Example 1

FIG. 1 illustrates the formulation performance data for percent soil removal for high silicate, clay, and transportation oily soil types. As illustrated, the soil removal composition of the present invention performed equally as well in percent soil removal as the commercially available "wheel cleaning" solutions (Commercial Products A-C) which contain volatile organic compound solvents.

Example 2

Figure 2:
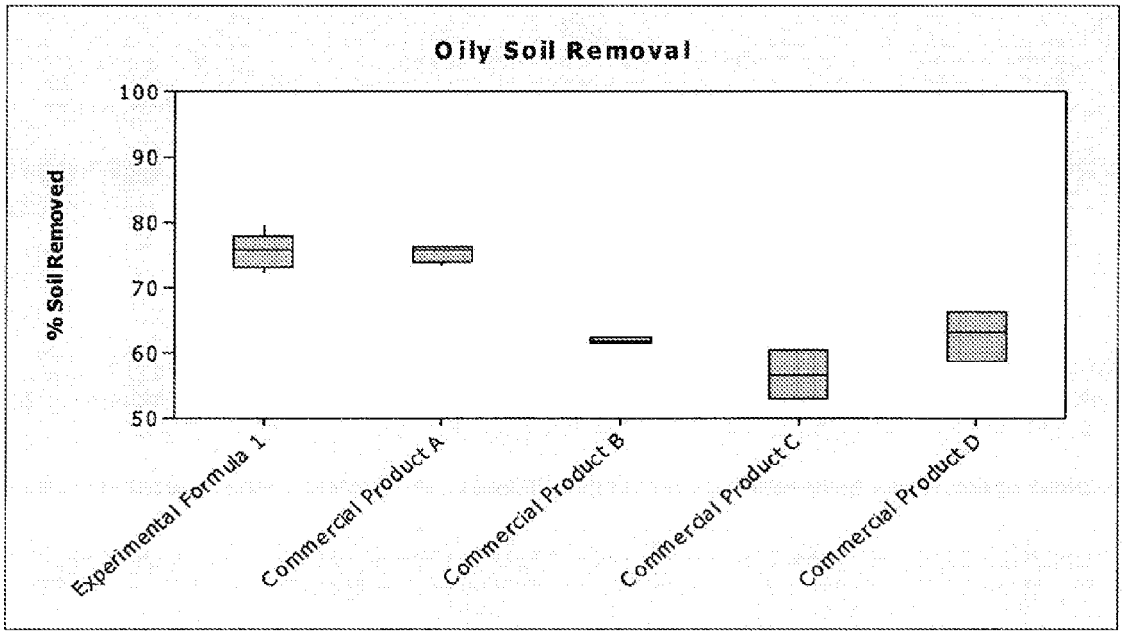
FIG. 2 is a graph illustrating the percent soil removal for oily soil types.

FIG. 2 illustrates the percent soil removal for oily soil types. As illustrated, the soil removal composition of the present invention had a higher soil removal percentage in comparison to the commercially available "wheel cleaning" solutions (Commercial Products A-D which contain volatile organic compound solvents).

Example 3

Figure 3:
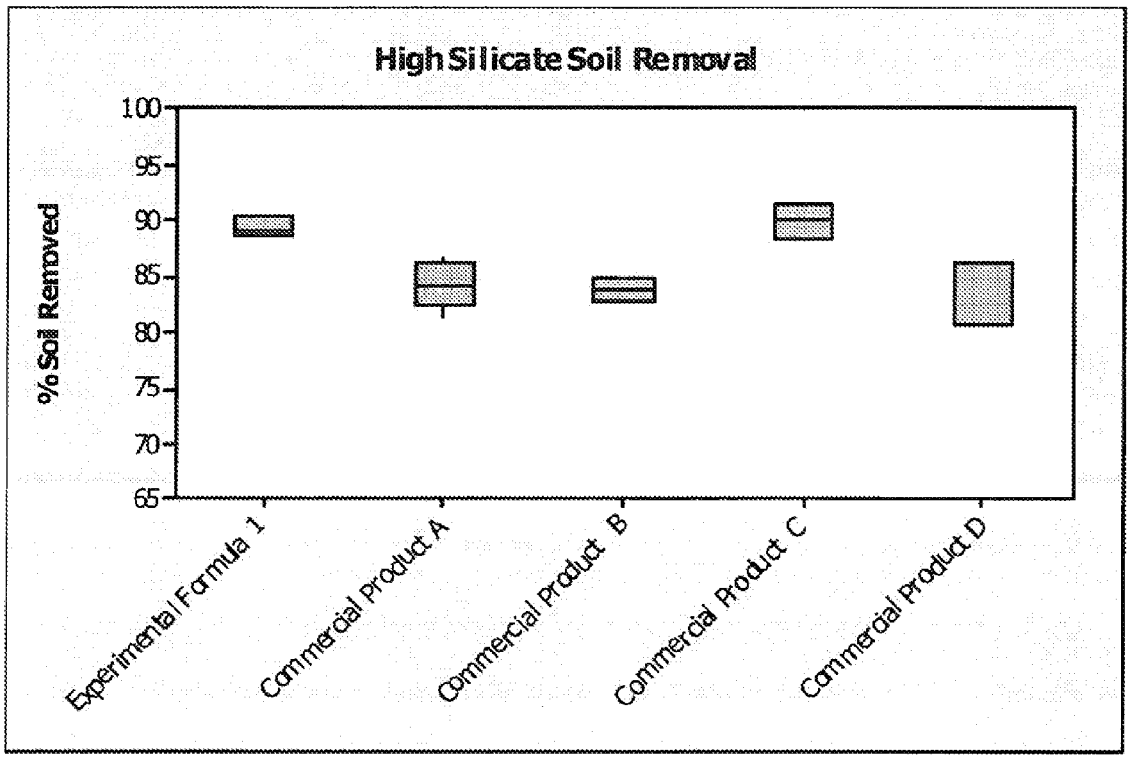
FIG. 3 is a graph illustrating the percent soil removal for high silicate soil types.

FIG. 3 illustrates the percent soil removal for high silicate soil types. As illustrated, the soil removal composition of the present invention had a higher soil removal percentage in comparison to the commercially available "wheel cleaning" solutions (Commercial Products A-D which contain volatile organic compound solvents).

Example 4

Figure 4:
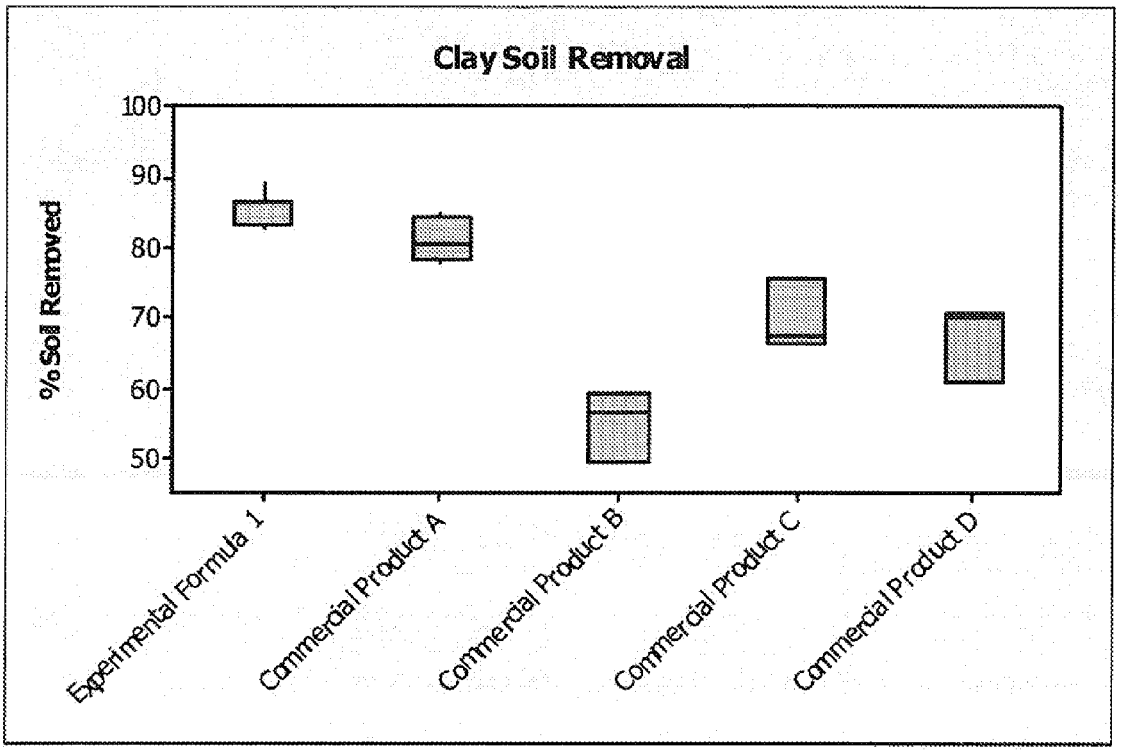
FIG. 4 is a graph illustrating the percent soil removal for clay soil types.

FIG. 4 illustrates the percent soil removal for clay soil types. As illustrated, the soil removal composition of the present invention had a higher soil removal percentage in comparison to the commercially available "wheel cleaning" solutions (Commercial Products A-D which contain volatile organic compound solvents).

The above specification, examples and data provide a complete description of the manufacture and use of the composition of the invention. Since many embodiments of the invention can be made without departing from the spirit and scope of the invention, the invention resides in the claims hereinafter appended.

We claim:

1. A hydrophobic and particulate soil removal composition comprising:

(a) a chelant;

(b) an alkaline agent;

(c) an effective treating amount of an alkyl ethoxylate mixture containing two or more ethoxylate groups and having the formula:

$$R_1—(OC_2H_4)_m—OH$$

wherein $R_1$ contains about 6 to about 26 carbon atoms and m is an average value of 1 to 20;

(d) an effective treating amount of a coco-based fatty acid ester component having the formula:

$$R_3—CO_2—R_4$$

wherein $R_3$ is an alkyl group having about 6 to about 24 carbon atoms and $R_4$ is an alkyl group having about 1 to about 6 carbon atoms, wherein the composition is free of hydrocarbons; and (e) a surfactant.

2. The composition of claim 1, wherein the composition may be diluted to a usable product, wherein the usable product comprises between full strength to about 1 part concentrated composition to 80 parts water.

3. The composition of claim 1, wherein the composition comprises between about 0.05 wt. % to about 20 wt. % chelant.

4. The composition of claim 3, wherein the chelant comprises of at least one of an iron oxide sequestrant and/or a metal oxide sequestrant, such as aluminum, calcium, zinc, and/or magnesium.

5. The composition of claim 1, wherein the composition comprises between about 0.05 wt. % to about 15 wt. % alkaline agent.

6. The composition of claim 5, wherein the alkaline agent comprises of sodium hydroxide, potassium hydroxide, monoethanolamine, potassium carbonate, sodium carbonate, sodium silicate, potassium silicate, and/or trisodium phosphate.

7. The composition of claim 1, wherein the composition comprises between about 0.01 wt. % to about 20 wt. % alkyl ethoxylate mixture.

8. The composition of claim 1, wherein the composition comprises between about 0.005 wt. % to about 5 wt. % fatty acid ester.

9. The composition of claim 1, wherein the fatty acid ester component comprises a fatty acid ester of at least one of soy, oleic, linoleic, linolenic, ricinoleic, cocoinic, myristic, palmitic, and/or lauric acid.

10. The composition of claim 1, wherein the fatty acid ester component comprises at least one of methyl soyate, ethyl soyate, propyl soyate, methyl oleate, ethyl oleate, propyl oleate, methyl ricinoleate, ethyl ricinoleate, propyl ricinoleate, methyl linoleate, ethyl linoleate, propyl linoleate, methyl linolenate, ethyl linolenate, propyl linolenate, methyl cocoate, ethyl cocoate, propyl cocoate, methyl palmitate, ethyl palmitate, propyl palmitate, methyl laurate, ethyl laurate, propyl laurate, methyl myristate, ethyl myristate, and/or propyl myristate.

11. The composition of claim 1, wherein the composition comprises between about 0.001 wt. % to about 5 wt. % surfactant, specifically a quaternary surfactant.

12. The composition of claim 1, wherein $R_1$ comprises a linear saturated aliphatic group.

13. The composition of claim 1, wherein $R_3$ is a mixed alkyl group having about 12 and 14 carbon atoms, specifically $R_3$ is a mixture of n-dodecanyl and n-tetradecanyl.

14. The composition of claim 1, wherein $R_4$ is a methyl or single carbon group.

15. The composition of claim 1, wherein the composition further comprises:

(a) between about 0.001 wt. % to about 5 wt. % corrosion inhibitor;

(b) between about 0.01 wt. % to about 5. wt. % hydrotrope;

(c) between about 0.001 wt. % to about 10 wt. % solubilizing agent; and (d) between about 0.01 wt. % to about 15 wt. % foaming agent.

16. The composition of claim 15, wherein the corrosion inhibitor is selected from the group comprising of sodium silicate and/or potassium silicate.

17. The composition of claim 15, wherein the hydrotrope is selected from the group comprising of sodium xylene sulfonate, sodium cumene sulfonate, sodium naphthalene sulfonate, potassium xylene sulfonate, potassium cumene sulfonate and/or potassium napthphtalene sulfonate.

18. The composition of claim 15, wherein the solubilizing agent is selected from the group comprising of sodium alkyl dipropionate, sodium alkyl sulfosuccinate, sodium alkyl betaine, potassium alkyl dipropionate, potassium alkyl sulfosuccinate, and/or potassium alkyl betaine.

19. The composition of claim 15, wherein the foaming agent is selected from the group comprising of sodium alkyl betaine, sodium alkyl sultaine, sodium alkyl sarcosinate, sodium alkyl sulfonate, sodium alkyl sulfate, potassium alkyl betaine, potassium alkyl sultaine, potassium alkyl sarcosinate, potassium alkyl sulfonate, and/or potassium alkyl sulfate.

20. The composition of claim 1, wherein the composition contacts a hydrophobic and particulate soiled article, wherein the soiled article comprises an article soiled by at least one of motor oils, asphaltenes, hydrocarbon tars, coal tars, petroleum fluids, transmission fluids, hydraulic oils, and lubricant greases.

21. The composition of claim 20, wherein the soiled article comprises a rubber hard surface, a painted plastic surface, a painted metal surface, a plastic surface and/or a metal surface, such as aluminum, magnesium, steel, chrome-plated aluminum, chrome-plated magnesium, and/or chrome-plated steel, clear coated aluminum, and/or clear coated magnesium.

22. The composition of claim 20, wherein the step of contacting comprises contacting for about 1 second to about 600 seconds.

23. The composition of claim 20, wherein after the composition contacts a hydrophobic and particulate soiled article the composition is rinsed from the article.

24. The composition of claim 20, wherein the hydrophobic and particulate soil comprises motor oil, particulate carbon, particulate limestone, particulate concrete, rubber, asphalt, road film, brake dust, clay, and/or mixtures thereof.

25. The composition of claim 20, wherein the article comprises a motor vehicle part.

* * * * *